US007986097B2

(12) United States Patent
Kweon et al.

(10) Patent No.: US 7,986,097 B2
(45) Date of Patent: Jul. 26, 2011

(54) PLASMA DISPLAY PANEL

(75) Inventors: Tae-Joung Kweon, Suwon-si (KR); Sung-Hune Yoo, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 12/588,674

(22) Filed: Oct. 23, 2009

(65) Prior Publication Data

US 2010/0109527 A1 May 6, 2010

(30) Foreign Application Priority Data

Nov. 6, 2008 (KR) ..... 10-2008-0110012

(51) Int. Cl.
*H01J 17/49* (2006.01)

(52) U.S. Cl. ..... 313/582; 313/586

(58) Field of Classification Search ..... None
See application file for complete search history.

(56) References Cited

U.S. PATENT DOCUMENTS

| | | | | |
|---|---|---|---|---|
| 2007/0228957 | A1* | 10/2007 | Kang et al. | 313/582 |
| 2010/0007585 | A1* | 1/2010 | Fujiwara | 345/60 |
| 2010/0056010 | A1* | 3/2010 | Nishinaka et al. | 445/25 |
| 2010/0060166 | A1* | 3/2010 | Nishinaka et al. | 313/634 |
| 2010/0084974 | A1* | 4/2010 | Morioka et al. | 313/587 |
| 2010/0130090 | A1* | 5/2010 | Nishinaka et al. | 445/25 |

FOREIGN PATENT DOCUMENTS

KR 10-2006-0025893 A 3/2006

* cited by examiner

*Primary Examiner* — Ashok Patel
(74) *Attorney, Agent, or Firm* — Lee & Morse, P.C.

(57) ABSTRACT

A PDP includes a first substrate and a second substrate facing each other, a plurality of first discharge electrodes on the first substrate, a first dielectric layer covering the first discharge electrodes, a plurality of second discharge electrodes on the second substrate and intersecting the first discharge electrodes, a second dielectric layer covering the second discharge electrodes, and a sealing material between the first substrate and the second substrate, wherein an absolute value of thermal expansion coefficient difference between the second dielectric layer and the sealing material is less than or equal to $13\times10^{-7}/°$ C.

16 Claims, 2 Drawing Sheets

PLASMA DISPLAY PANEL

BACKGROUND

1. Field

Embodiments relate to a plasma display panel (PDP) and, more particularly, to a PDP that can reduce or prevent damage to a substrate due to thermal expansion coefficient mismatch between a dielectric layer and frit glass.

2. Description of the Related Art

In general, a PDP is flat display devices in which a predetermined discharge gas is injected between two substrates having a plurality of discharge electrodes thereon to generate a mutual discharge. Vacuum ultraviolet radiation generated by the mutual discharge excites phosphor materials of phosphor layers, thereby realizing display of desired numbers, text, or graphics.

Due to the recent demand for large PDPs, a multi-cutting process technology that enables production of a plurality of, e.g., two to eight, divided glass substrates from a mother glass is used in a manufacturing process to improve efficiency. That is, the mother glass can be divided into unit substrates by forming various pattern layers, e.g., pairs of discharge electrode, a dielectric layer formed to cover the pairs of discharge electrodes, barrier ribs, phosphor layers, and frit glass, are formed on each of the unit substrates, and then cutting a border portion between each of the unit substrates of the mother glass to form unit substrates.

However, conventional PDPs have problems in that, as multiple substrates are obtained at the same time, the substrates are vulnerable to damage due to differences in bending, thermal deformation, contraction, and so forth.

SUMMARY

Embodiments are therefore directed to a PDP, which substantially overcome one or more of the problems due to the limitations and disadvantages of the related art.

It is therefore a feature of an embodiment to provide a PDP that can reduce thermal expansion coefficient mismatch and prevent damage to a substrate by allowing the absolute value of a thermal expansion coefficient difference between a dielectric layer and a sealing material to be defined by a specific numerical formula.

At least one of the above and other features and advantages may be realized by providing a PDP, including a first substrate and a second substrate facing each other, a plurality of first discharge electrodes on the first substrate, a first dielectric layer covering the first discharge electrodes, a plurality of second discharge electrodes on the second substrate and intersecting the discharge electrodes, a second dielectric layer covering the second discharge electrodes, and a sealing material between the first substrate and the second substrate, wherein an absolute thermal expansion coefficient difference between the second dielectric layer and the sealing material is less than or equal to $13\times10^{-7}/°$ C.

The second dielectric layer may be formed of at least one of a lead-based material, a bismuth-based material, a boron-zinc-based material, and a boron-alumina-based material.

The lead-based material may have a thermal expansion coefficient of about $60\times10^{-7}/°$ C. to about $85\times10^{-7}/°$ C., the bismuth-based material may have a thermal expansion coefficient of about $65\times10^{-7}/°$ C. to about $90\times10^{-7}/°$ C., the boron-zinc-based material may have a thermal expansion coefficient of about $75\times10^{-7}/°$ C. to about $95\times10^{-7}/°$ C., and the boron-alumina-based material may have a thermal expansion coefficient of about $70\times10^{-7}/°$ C. to about $90\times10^{-7}/°$ C.

The sealing material may be formed of a lead-based material or a bismuth-based material.

The lead-based material may have a thermal expansion coefficient of about $60\times10^{-7}/°$ C. to about $85\times10^{-7}/°$ C., and the bismuth-based material may have a thermal expansion coefficient of about $70\times10^{-7}/°$ C. to about $90\times10^{-7}/°$ C.

The first discharge electrodes may be sustain electrode pairs arranged in one direction of the first substrate, and the second discharge electrodes may be address electrodes arranged in one direction of the second substrate.

The sealing material may be along edges of inner surfaces of the first substrate and the second substrate facing each other.

The sealing material may be between a surface of the first dielectric layer covering the discharge electrodes and a surface of the second dielectric layer covering the address electrodes.

A protective layer may be between the surface of the first dielectric layer and the sealing material.

The PDP may further include discharge barrier ribs in a display area where an image is displayed and dummy barrier ribs in a non-display area that is an area other than the display area, wherein the sealing material is continuously provided along edges of at least one of the first substrate and the second substrate in the non-display area outside the dummy barrier ribs.

The PDP may further include Red, green, and blue phosphor layers in a space formed by the discharge barrier ribs, wherein no phosphor layers in a space formed by the dummy barrier ribs.

At least one of the above and other features and advantages may also be realized by providing a PDP, including a substrate, a plurality of discharge electrodes disposed on the substrate, a dielectric layer covering the discharge electrodes, and a sealing material on the substrate, wherein an absolute thermal expansion coefficient difference between the second dielectric layer and the sealing material is less than or equal to $13\times10^{-7}/°$ C.

The dielectric layer may be formed of at least one of a lead-based material, a bismuth-based material, a boron-zinc-based material, and a boron-alumina-based material.

The lead-based material may have a thermal expansion coefficient of about $60\times10^{-7}/°$ C. to about $85\times10^{-7}/°$ C., the bismuth-based material may have a thermal expansion coefficient of about $65\times10^{-7}/°$ C. to about $90\times10^{-7}/°$ C., the boron-zinc-based material may have a thermal expansion coefficient of about $75\times10^{-7}/°$ C. to about $95\times10^{-7}/°$ C., and the boron-alumina-based material may have a thermal expansion coefficient of about $70\times10^{-7}/°$ C. to about $90\times10^{-7}/°$ C.

The sealing material may be formed of a lead-based material or a bismuth-based material.

The lead-based material may have a thermal expansion coefficient of about $60\times10^{-7}/°$ C. to about $85\times10^{-7}/°$ C., and the bismuth-based material may have a thermal expansion coefficient of about $70\times10^{-7}/°$ C. to about $90\times10^{-7}/°$ C.

The discharge electrodes may produce an address discharge.

The sealing material may be formed on a surface of the dielectric layer covering the discharge electrodes.

The sealing material may be continuously provided along edges of the substrate.

The PDP may further include discharge barrier ribs in a display area where an image is displayed and dummy barrier ribs in a non-display area that is an area other than the display area, wherein the sealing material is continuously provided along edges of at least one of the first substrate and the second substrate in the non-display area outside the dummy barrier ribs.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
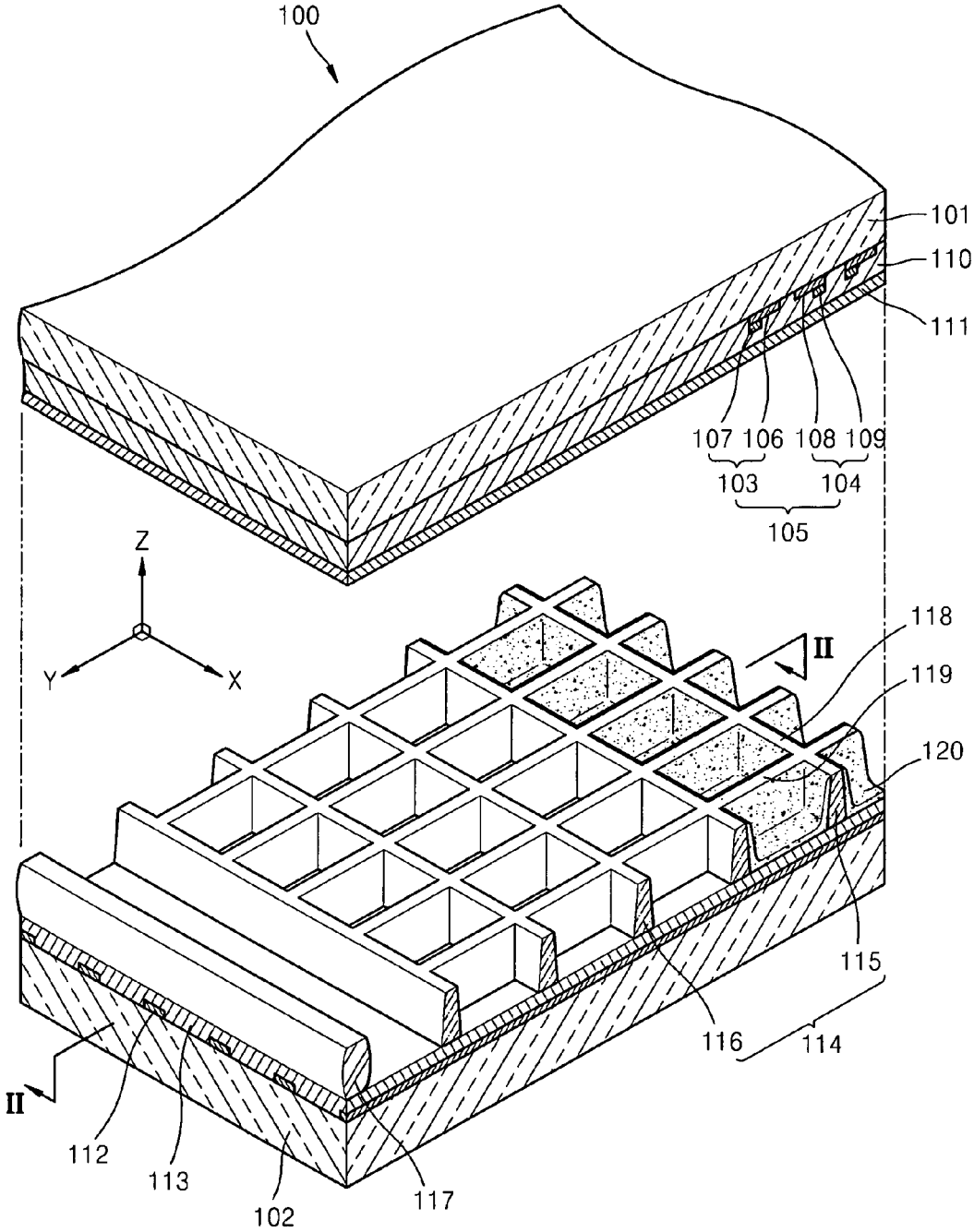
FIG. 1 illustrates an exploded partially cut perspective view of a PDP according to an embodiment.

Korean Patent Application No. 10-2008-0110012, filed on Nov. 6, 2008, in the Korean Intellectual Property Office, and entitled: "Plasma Display Panel," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
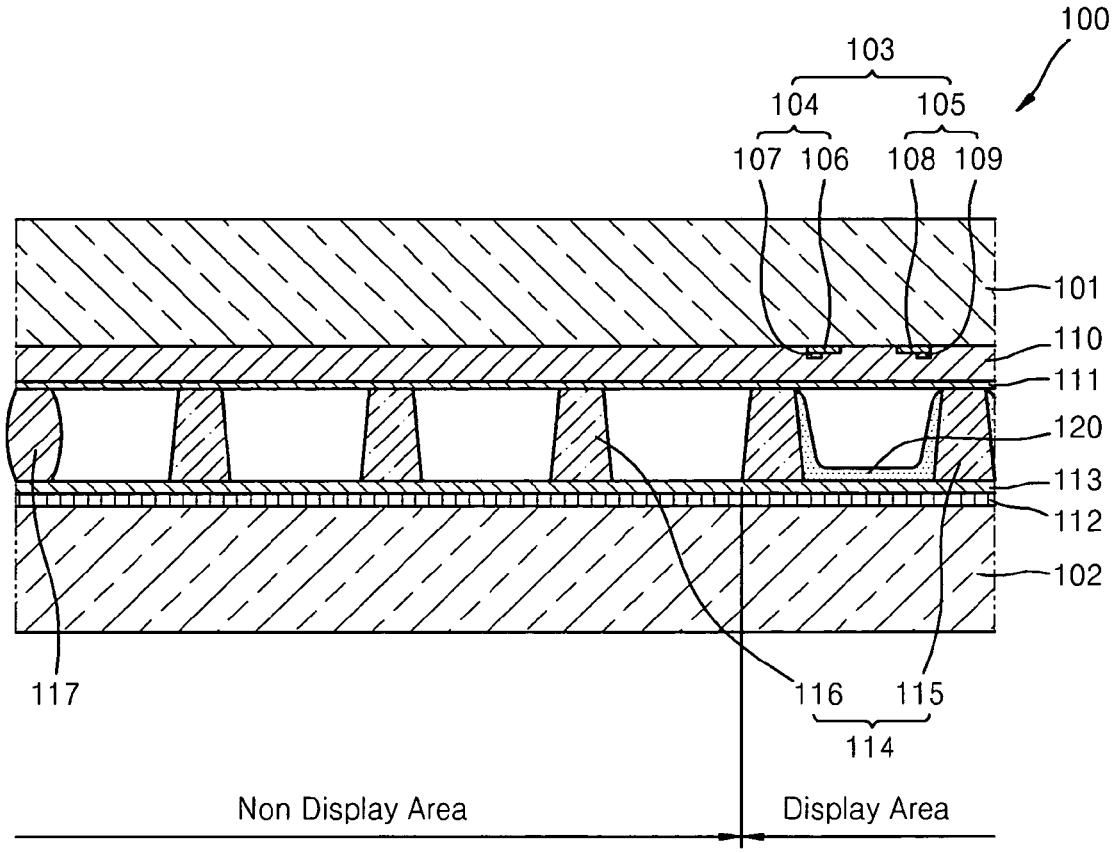
FIG. 2 illustrates a cross-sectional view taken along line II-II of FIG. 1.

FIG. 1 illustrates an exploded partially cut perspective view of a PDP 100 according to an embodiment. FIG. 2 illustrates a cross-sectional view taken along line II-II of FIG. 1.

Referring to FIGS. 1 and 2, the PDP 100 may include a first substrate 101 and a second substrate 102 facing the first substrate 101. A sealing material 117, e.g., frit glass, may be coated along edges of inner surfaces of the first substrate 101 and the second substrate 102 facing each other. The sealing material 117 may seal an inner space formed when the first substrate 101 and the second substrate 102 are coupled to each other.

The first substrate 101 may be a transparent substrate formed of, e.g., soda lime glass, or an opaque substrate formed of, e.g., colored glass or synthetic resin.

Sustain electrode pairs 105 including X electrodes 103 and Y electrodes 104 may be formed on an inner surface of the first substrate 101 extending along an x-axis direction of the PDP 100. The X electrodes 103 and the Y electrodes 104 may be alternately arranged in a y-axis direction and one sustain electrode pair including an X electrode 103 and a Y electrode 104 may be disposed in each discharge cell.

Each of the X electrodes 103 may include a first transparent electrode 106 formed on the inner surface of the first substrate 101 and a first bus electrode line 107 electrically connected to the first transparent electrode 106. The first transparent electrode 106 may have a rectangular cross-section and may be disposed in each discharge cell. The first bus electrode lines 107 may be on the first substrate 101 in a stripe pattern along the x-axis direction.

Each of the Y electrodes 104 may be symmetric with respect to the X electrode 103, and may include a second transparent electrode 108 formed on the inner surface of the first substrate 101 and a second bus electrode line 109 electrically connected to the second transparent electrode 108. The second transparent electrode 108 may have a rectangular cross-section and may be disposed in each discharge cell to face the first transparent electrode 106. The second bus electrode lines 109 may be on the first substrate 101 in a stripe pattern along the x-axis direction.

Each of the first transparent electrode 106 and the second transparent electrode 108 may be a transparent conductive layer, e.g., an indium tin oxide (ITO) layer, to improve an aperture ratio of the first substrate 101. Each of the first bus electrode line 107 and the second bus electrode line 109 may be formed of, e.g., silver (Ag) paste or a chrome-copper-chrome (Cr—Cu—Cr) alloy to improve conductivity. The first transparent electrode 106 and the second transparent electrode 108 may be disposed apart from each other by a predetermined distance at a center of each of discharge cells, thereby forming a discharge gap.

A space between one sustain electrode pair 105 disposed in one discharge cell and other sustain electrode pair 105 disposed in adjacent discharge cell may be a non-discharge area. An insulating black stripe layer (not shown) may be further formed in the non-discharge area to improve contrast.

The sustain electrode pairs 105 may be covered by a first dielectric layer 110. The first dielectric layer 110 may be formed of a glass paste containing various fillers.

A protective layer 111 may be formed of magnesium oxide (MgO) on a surface of the first dielectric layer 110 to prevent damage to the first dielectric layer 110 and to obtain a higher secondary electron emission yield.

The second substrate 102 may be formed of substantially the same material as that of the first substrate 101, and the material of the second substrate 102 may vary according to the type of PDP 100, e.g., a transmissive type or a reflective type.

Address electrodes 112 may be disposed on the inner surface of the second substrate 102 along the y-axis direction. The address electrodes 112 may be disposed to intersect the X and Y electrodes 103 and 104. The address electrodes 112 may be covered by a second dielectric layer 113.

Barrier ribs 114 may be formed between the first substrate 101 and the second substrate 102 to define discharge cells together with the first substrate 101 and the second substrate 102. The barrier ribs 114 may include a plurality of discharge barrier ribs 115 disposed in a display area and dummy barrier ribs 116 disposed in a non-display area, i.e., an area other than the display area. For example, the non-display area may be an area between the display area and an area where the sealing material 117 is located.

The discharge barrier ribs 115 may include first walls 118 intersecting the address electrodes 112, e.g., extending along the x-axis direction, and second walls 119 parallel to the address electrodes 112, e.g., extending along the y-axis direction. Since the first walls 118 and the second walls 119 may be arranged in rows and columns to intersect each other, the discharge barrier ribs 115 may be formed in a matrix pattern.

Alternatively, the discharge barrier ribs 115 may be formed in, e.g., a meander pattern, a delta pattern, or a honeycomb pattern. In this case, the discharge cells defined by the discharge barrier ribs 115 may have, e.g., polygonal, circular, or oval cross-sections.

Red, green, and blue phosphor layers 120 may be coated in the discharge space formed by the discharge barrier ribs 115 and may emit light to display an image during a discharge. The red phosphor layers may be formed of $(Y,Gd)BO_3:Eu^{3+}$, the green phosphor layers may be formed of $Zn_2SiO_4:Mn^{2+}$, and the blue phosphor layers may be formed of $BaMgAl_{10}O_{17}:Eu^{2+}$.

The dummy barrier ribs 116 disposed in the non-display area may be integrally connected to the discharge barrier ribs 115 to prevent the discharge barrier ribs 115 from being deformed when the barrier ribs 114 are patterned. For example, the dummy barrier ribs 116 may have the same form as the discharge barrier ribs 115 and may be, e.g., formed in a matrix pattern, a meander pattern, a delta pattern, or a honeycomb pattern. The cells defined by the dummy barrier ribs 116 may have, e.g., rectangular polygonal, circular, or oval cross-sections. Unlike the discharge barrier ribs 115, the red, green, and blue phosphor layers 120, however, may not be coated in a space formed by the dummy barrier ribs 116.

A discharge gas, e.g., neon (Ne)-xenon (Xe) or helium (He)-xenon (Xe), may be injected into the discharge cells defined by the first substrate 101, the second substrate 102, and the barrier ribs 114.

The absolute value of a thermal expansion coefficient difference between the second dielectric layer 113 and the sealing material 117 may be defined by a specific numerical formula to ensure that the thermal expansion coefficients sufficiently match, which will be explained in detail below.

The sealing material 117, e.g., frit glass, may be coated on a surface of the second dielectric layer 113 covering the address electrodes 112 to seal the inner space formed when the first substrate 101 and the second substrate 102 are coupled to each other.

The sealing material 117 may be coated along the edges of the inner surface of the first substrate 101 or the second substrate 102 outside the dummy barrier ribs 116, e.g., toward the edge of the first and second substrates 101 and 102, in a continuous shape. For example, the sealing material 117 may be coated along the edge of the inner surface of the second substrate 102 in the non-display area at a predetermined distance from the dummy barrier ribs 116. The sealing material 117 may be coated along an entire periphery of the first substrate 101 and the second substrate 102, e.g., may be on the second dielectric layer 113. There may be a predetermined space between the sealing material 117 and an outermost dummy barrier rib 116 from the display area, closest to the sealing material 117. The sealing material 117 may be disposed apart from the discharge barrier ribs 115 by having the dummy barrier ribs 116 therebetween. The sealing material 117 may have a height that is substantially the same as that of the barrier ribs 114. The sealing material 117 may have a width of eight to ten millimeters to maintain reliable sealing.

The second dielectric layer 113 may be formed of a lead-based material, e.g., $PbO—B_2O_3—SiO_2$, having a thermal expansion coefficient of about $60\times10^{-7}/°$ C. to about $85\times10^{-7}/°$ C., a bismuth-based material, e.g., $Bi_2O_3—B_2O_3—SiO_2$, having a thermal expansion coefficient of about $65\times10^{-7}/°$ C. to about $90\times10^{-7}/°$ C., a boron-zinc-based material, e.g., $B_2O_3—ZnO—SiO_2$, having a thermal expansion coefficient of about $75\times10^{-7}/°$ C. to about $95\times10^{-7}/°$ C., or a boron-alumina-based material, e.g., $B_2O_3—SiO_2—Al_2O_3$, having a thermal expansion coefficient of about $70\times10^{-7}/°$ C. to about $90\times10^{-7}/°$ C.

The sealing material 117 may be formed of a lead-based material, e.g., PbO, having a thermal expansion coefficient of about $60\times10^{-7}/°$ C. to about $85\times10^{-7}/°$ C., or a bismuth-based material, e.g., $Bi_2O_3$, having a thermal expansion coefficient of about $70\times10^{-7}/°$ C. to about $90\times10^{-7}/°$ C.

A thermal expansion coefficient difference between the second dielectric layer 113 and the sealing material 117 may satisfy below Formula 1

$$|\text{thermal expansion coefficient of second dielectric layer}-\text{thermal expansion coefficient of sealing material}|\leqq 13\times10-7/°\text{ C.} \quad (1).$$

A defect that frequently occurs in the multi-cutting process technology, which is used in manufacturing of a PDP to improve efficiency, may be warping of a panel. In particular, the substrates are often damaged due to thermal expansion coefficient mismatch between sealing material, e.g., frit glass, which may be the thickest pattern layer, and a dielectric layer disposed under the frit glass.

Once thermal expansion coefficient mismatch occurs between the frit glass and the dielectric layer, the substrates may be damaged during a baking process of the frit glass, may be damaged due to a temperature difference between a panel effective part and a panel outskirt part during an aging process, and may be damaged due to a pressure applied during electrical connection between a signal transmitting unit and discharge electrodes.

Accordingly, it may be very important to ensure appropriate thermal expansion coefficient match between the frit glass and the dielectric layer to reduce damage during the processes. Also, as interest in restricting the use of hazardous substances has been recently increased, lead-free materials are being developed. Even using a lead-free material, a thermal expansion coefficient should be one of the factors to be deliberately considered in selecting the material.

If an absolute value of the thermal expansion coefficient difference between the second dielectric layer 113 and the sealing material 117 satisfies Formula 1, damage to the first substrate 101 or the second substrate 102 during a baking process of the sealing material 117, damage to the PDP 100 during an aging process, and/or damage during electrical connection between a signal transmitting unit and the discharge electrodes may be reduced or prevented.

Experiments were conducted to determine the effect of thermal expansion coefficient mismatch between a second dielectric layer and a sealing material, and results thereof are shown in Table 1.

The experiments were performed by checking for damage to a substrate during a baking process of the sealing material, damage to a PDP during an aging process, and damage during electrical connection between a signal transmitting unit and discharge electrodes as a thermal expansion coefficient difference between the second dielectric layer and the sealing material was changed.

TABLE 1

| Thermal expansion coefficient of second dielectric layer - thermal expansion coefficient of sealing material ($\times 10^{-7}/°$ C.) | Damage during baking process | Damage during aging process | Damage during electrical connection between signal transmitting unit and discharge electrodes | Total number of damage cases |
|---|---|---|---|---|
| −17 | 4 | 6 | 4 | 14 |
| −16 | 3 | 5 | 4 | 12 |
| −15 | 2 | 4 | 2 | 8 |
| −14 | 2 | 3 | 1 | 6 |
| −13 | 0 | 1 | 0 | 1 |
| −12 | 0 | 0 | 0 | 0 |
| −10 | 0 | 0 | 0 | 0 |
| −5 | 0 | 0 | 0 | 0 |
| 0 | 0 | 0 | 0 | 0 |
| 5 | 0 | 0 | 0 | 0 |
| 10 | 0 | 0 | 0 | 0 |
| 12 | 0 | 0 | 0 | 0 |
| 13 | 0 | 0 | 0 | 0 |
| 14 | 0 | 3 | 0 | 3 |
| 15 | 2 | 3 | 0 | 5 |
| 16 | 4 | 4 | 2 | 8 |
| 17 | 4 | 5 | 3 | 12 |

Referring to Table 1, when the absolute value of the thermal expansion coefficient difference between the second dielectric layer and the sealing material was equal to or less than 13, only one damaged case occurred, thereby ensuring good process yield. Accordingly, if the absolute value of the thermal expansion coefficient difference between the second dielectric layer and the sealing material was equal to or less than 13, damage due to thermal expansion coefficient mismatch between the second dielectric layer and the sealing material may be prevented.

Experiments were conducted to determine if damage to the substrate would occur when the materials of the second dielectric layer and the sealing material were changed, thereby changing the absolute value of thermal expansion coefficient difference between the second dielectric layer and the sealing material, and results thereof are shown in Table 2.

TABLE 2

| | Thermal expansion coefficient of second dielectric layer | Thermal expansion coefficient of sealing material | Thermal expansion coefficient of second dielectric layer - thermal expansion coefficient of sealing material ($\times 10^{-7}/°$ C.) | Result |
|---|---|---|---|---|
| Embodiment 1 | 70 (lead-based) | 65 (lead-based) | 5 | Good |
| Embodiment 2 | 70 (boron-zinc-based, boron-alumina-based) | 80 (bismuth-based) | −10 | Good |
| Embodiment 3 | 72 (boron-zinc-based, boron-alumina-based) | 77 (lead-based, bismuth-based) | −5 | Good |
| Embodiment 4 | 68 (lead-based, bismuth-based) | 81 (bismuth-based) | −13 | Good |
| Embodiment 5 | 80 (bismuth-based) | 67 (lead-based) | 13 | Good |
| Comparative example 1 | 68 (lead-based, bismuth-based) | 82 (bismuth-based) | −14 | Damage |
| Comparative example 2 | 84 (bismuth-based) | 70 (lead-based, bismuth-based) | 14 | Damage |

Referring to Table 2, when the absolute value of a thermal expansion coefficient difference between the second dielectric layer and the sealing material was equal to or less than 13, the substrate was not damaged. When the absolute value of the thermal expansion coefficient difference between the second dielectric layer and the sealing material was greater than 13, as in the comparative examples 1 and 2, both substrates were damaged.

As described above, the PDP according to the present embodiment may reduce or prevent damage due to thermal expansion coefficient mismatch between the dielectric layer and the sealing material by allowing the absolute value of the thermal expansion coefficient difference between the second dielectric layer and the sealing material to be defined by a specific numerical formula.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a first substrate and a second substrate facing each other;

a plurality of first discharge electrodes on the first substrate;

a first dielectric layer covering the first discharge electrodes;

a plurality of second discharge electrodes on the second substrate and intersecting the first discharge electrodes;

a second dielectric layer covering the second discharge electrodes; and a sealing material between the first substrate and the second substrate, the sealing material being formed of a bismuth-based material having a thermal expansion coefficient of about $70\times10^{-7}$/° C. to about $90\times10^{-7}$/° C., and an absolute value of thermal expansion coefficient difference between the second dielectric layer and the sealing material is less than or equal to $13\times10^{-7}$/° C.

2. The PDP as claimed in claim 1, wherein the second dielectric layer is formed of at least one of a lead-based material, a second bismuth-based material, a boron-zinc-based material, and a boron-alumina-based material.

3. The PDP as claimed in claim 2, wherein the lead-based material has a thermal expansion coefficient of about $60\times10^{-7}$/° C. to about $85\times10^{-7}$/° C., the second bismuth-based material has a thermal expansion coefficient of about $65\times10^{-7}$/° C. to about $90\times10^{-7}$/° C., the boron-zinc-based material has a thermal expansion coefficient of about $75\times10^{-7}$/° C. to about $95\times10^{-7}$/° C., and the boron-alumina-based material has a thermal expansion coefficient of about $70\times10^{-7}$/° C. to about $90\times10^{-7}$/° C.

4. The PDP as claimed in claim 1, further comprising discharge barrier ribs in a display area where an image is displayed and dummy barrier ribs in a non-display area that is an area other than the display area, wherein the sealing material is continuously provided along edges of, at least one of the first substrate and the second substrate in the non-display area outside the dummy barrier ribs.

5. The PDP as claimed in claim 4, further comprising red, green, and blue phosphor layers in a space formed by the discharge barrier ribs, wherein no phosphor layers are in a space formed by the dummy barrier ribs.

6. The PDP as claimed in claim 1, wherein the first discharge electrodes are sustain electrode pairs arranged in one direction of the first substrate, and the second discharge electrodes are address electrodes arranged in one direction of the second substrate.

7. The PDP as claimed in claim 1, wherein the sealing material is along edges of inner surfaces of the first substrate and the second substrate facing each other.

8. The PDP as claimed in claim 7, wherein the sealing material is between a surface of the first dielectric layer covering the discharge electrodes and a surface of the second dielectric layer covering the address electrodes.

9. The PDP as claimed in claim 8, further comprising a protective layer between the surface of the first dielectric layer and the sealing material.

10. A PDP, comprising:

a substrate;

a plurality of discharge electrodes disposed on the substrate;

a dielectric layer covering the discharge electrodes; and a sealing material on the substrate, the sealing material being formed of a bismuth-based material having a thermal expansion coefficient of about $70\times10^{-7}$/° C. to about $90\times10^{-7}$/° C., and an absolute thermal expansion coefficient difference between the dielectric layer and the sealing material is less than or equal to $13\times10^{-7}$/° C.

11. The PDP as claimed in claim 10, wherein the sealing material is continuously provided along edges of the substrate.

12. The PDP as claimed in claim 10, further comprising discharge barrier ribs in a display area where an image is displayed and dummy barrier ribs in a non-display area that is an area other than the display area, wherein the sealing material is continuously provided along edges of, at least one of the first substrate and the second substrate in the non-display area outside the dummy barrier ribs.

13. The PDP as claimed in claim 10, wherein the dielectric layer is formed of at least one of a lead-based material, a second bismuth-based material, a boron-zinc-based material, and a boron-alumina-based material.

14. The PDP as claimed in claim 13, wherein the lead-based material has a thermal expansion coefficient of about $60\times10^{-7}$/° C. to about $85\times10^{-7}$/° C., the second bismuth-based material has a thermal expansion coefficient of about $65\times10^{-7}$/° C. to about $90\times10^{-7}$/° C., the boron-zinc-based material has a thermal expansion coefficient of about $75\times10^{-7}$/° C. to about $95\times10^{-7}$/° C., and the boron-alumina-based material has a thermal expansion coefficient of about $70\times10^{-7}$/° C. to about $90\times10^{-7}$/° C.

15. The PDP as claimed in claim 10, wherein the discharge electrodes produce an address discharge.

16. The PDP as claimed in claim 10, wherein the sealing material is formed on a surface of the dielectric layer covering the discharge electrodes.

* * * * *